US010633160B2

(12) United States Patent
Wessely

(10) Patent No.: US 10,633,160 B2
(45) Date of Patent: Apr. 28, 2020

(54) PACKAGING, COVER FILM AND USE OF SAME

(71) Applicant: GIESECKE+DEVRIENT CURRENCY TECHNOLOGY GMBH, München (DE)

(72) Inventor: Stephan Wessely, München (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 0 days.

(21) Appl. No.: 15/759,602

(22) PCT Filed: Sep. 26, 2016

(86) PCT No.: PCT/EP2016/001609
§ 371 (c)(1),
(2) Date: Mar. 13, 2018

(87) PCT Pub. No.: WO2017/054922
PCT Pub. Date: Apr. 6, 2017

(65) Prior Publication Data

US 2019/0039799 A1 Feb. 7, 2019

(30) Foreign Application Priority Data

Sep. 28, 2015 (DE) ..... 10 2015 012 581
Dec. 1, 2015 (DE) ..... 10 2015 015 730

(51) Int. Cl.
*B65D 75/36* (2006.01)
*A61J 1/03* (2006.01)
(Continued)

(52) U.S. Cl.
CPC ..... *B65D 75/367* (2013.01); *A61J 1/035* (2013.01); *B42D 25/28* (2014.10); *B42D 25/364* (2014.10);
(Continued)

(58) Field of Classification Search
USPC ..... 206/459.1, 528, 531, 532, 534, 534.1, 206/538
See application file for complete search history.

(56) References Cited

U.S. PATENT DOCUMENTS 5,871,831 A * 2/1999 Zeiter ..... A61J 7/0481 206/524.1
6,244,442 B1 6/2001 Inoue et al.
(Continued)

FOREIGN PATENT DOCUMENTS

DE 19613960 A1 10/1997
DE 10064616 A1 7/2002
(Continued)

OTHER PUBLICATIONS

German Search Report from DE Application No. DE 10 2015 015 730.2, dated Sep. 21, 2016.
(Continued)

*Primary Examiner* — Jacob K Ackun
(74) *Attorney, Agent, or Firm* — Workman Nydegger

(57) ABSTRACT

A packaging comprising a plastic foil molded part and a cover foil, wherein the plastic foil molded part defines the front side of the packaging and the cover foil defines the back side of the packaging and the cover foil is based on a carrier substrate provided with a semitransparent function layer, wherein the semitransparent function layer is constituted such that the cover foil has a first, visually recognizable color upon viewing in incident light and has a second, visually recognizable color upon viewing in transmitted light.

6 Claims, 6 Drawing Sheets

(51) Int. Cl.

| | |
|---|---|
| ***B42D 25/45*** | (2014.01) |
| ***B42D 25/378*** | (2014.01) |
| ***B42D 25/373*** | (2014.01) |
| ***B42D 25/364*** | (2014.01) |
| ***B65D 75/32*** | (2006.01) |
| ***B42D 25/28*** | (2014.01) |

(52) U.S. Cl.
CPC ..... *B42D 25/373* (2014.10); *B42D 25/378* (2014.10); *B42D 25/45* (2014.10); *B65D 75/327* (2013.01); *B65D 75/328* (2013.01); *A61J 2205/20* (2013.01); *A61J 2205/30* (2013.01); *B65D 2203/00* (2013.01)

(56) References Cited

U.S. PATENT DOCUMENTS

| | | | | |
|---|---|---|---|---|
| 6,375,956 | B1 * | 4/2002 | Hermelin | A61J 7/04 206/528 |
| 7,078,090 | B2 | 7/2006 | Tompkin et al. | |
| 9,274,258 | B2 | 3/2016 | Fuhse et al. | |
| 2003/0102247 | A1 | 6/2003 | Inoue et al. | |
| 2004/0076802 | A1 | 4/2004 | Tompkin et al. | |
| 2007/0235366 | A1 * | 10/2007 | Desai | B65D 75/327 206/531 |
| 2010/0155288 | A1 * | 6/2010 | Harper | B32B 3/28 206/531 |
| 2011/0049003 | A1 * | 3/2011 | Bellamah | B32B 15/08 206/531 |
| 2012/0152796 | A1 * | 6/2012 | Leon Alonso | A61J 1/035 206/531 |
| 2012/0170124 | A1 | 7/2012 | Fuhse et al. | |
| 2012/0242075 | A1 | 9/2012 | Lochbihler | |
| 2014/0214438 | A1 * | 7/2014 | Ahmadi | A61J 1/035 705/2 |
| 2015/0068930 | A1 * | 3/2015 | Alonso | A61J 1/035 206/223 |
| 2015/0122692 | A1 * | 5/2015 | Kavuru | A61J 1/035 206/530 |
| 2015/0192897 | A1 | 7/2015 | Schilling et al. | |
| 2015/0258838 | A1 | 9/2015 | Fuhse | |
| 2016/0039591 | A1 * | 2/2016 | Kinzer | A61K 31/352 424/10.3 |

FOREIGN PATENT DOCUMENTS

| | | | |
|---|---|---|---|
| DE | 102012105571 | A1 | 1/2014 |
| EP | 1356952 | A2 | 10/2003 |
| EP | 1876033 | A1 | 1/2008 |
| EP | 2090527 | A1 | 8/2009 |
| WO | 9710159 | A1 | 3/1997 |
| WO | 2005051675 | A2 | 6/2005 |
| WO | 2006056216 | A1 | 6/2006 |
| WO | 2009000403 | A1 | 12/2008 |
| WO | 2010139409 | A1 | 12/2010 |
| WO | 2011032665 | A1 | 3/2011 |
| WO | 2011064162 | A2 | 6/2011 |
| WO | 2011082761 | A1 | 7/2011 |
| WO | 2014060089 | A2 | 4/2014 |

OTHER PUBLICATIONS

International Search Report from PCT Application No. PCT/EP2016/001609, dated Jan. 20, 2017.

* cited by examiner

PACKAGING, COVER FILM AND USE OF SAME

BACKGROUND

The invention relates to a packaging, in particular a blister and further in particular to a tablet packaging, comprising a plastic foil molded part and a cover foil provided with a semitransparent function layer. The invention further relates to a cover foil suitable for covering a blister, in particular a tablet packaging, and the use of a foil provided with a semitransparent function layer as a cover foil of a packaging, such as of a blister, in particular of a tablet packaging or of a tablet blister.

A blister or a display packaging is understood to be a product packaging which enables the potential buyer to perceive the packaged object optically or to at least guess the form of the object. The object is fixed here by a plastic molded part closed with a cover foil. In the case of drugs, e.g. tablets, the cover foil mostly consists of aluminum. A tablet packaging or tablet blister is also called a push-through packaging. The arrangement of the tablets in individual depressions or cavities of the plastic molded part, which is sealed by the aluminum foil, is an advantage in terms of hygienic, because undesirable influences, such as high air humidity or dirt are excluded.

The production of blisters is described, e.g., in WO 97/010159 A1.

EP 1 876 033 A1 describes a packaging material, in particular for the pharmaceutical field, which has a metallic carrier substrate with a line grid printed in two different visually recognizable colours.

SUMMARY

The present invention is based on the general object of configuring the packaging known in the prior art more customer-friendly. Furthermore, the present invention is based on the preferred object of increasing the forgery resistance of the packagings of the prior art.

SUMMARY OF THE INVENTION 1. (First aspect of the invention) Packaging, comprising a plastic foil molded part and a cover foil, wherein the plastic foil molded part defines the front side of the packaging and the cover foil defines the back side of the packaging and the cover foil is based on a (in particular transparent or semitransparent) carrier substrate provided with a semitransparent function layer, wherein the semitransparent function layer is constituted such that the cover foil has a first, visually recognizable color upon viewing in incident light and has a second, visually recognizable color upon viewing in transmitted light.

The plastic foil molded part has, e.g., a depression or cavity or several depressions or cavities, the depressions or cavities being suitable for receiving objects to be packed, e.g., tablets. The plastic foil molded part is sealed or closed by the cover foil.

For manufacturing the plastic foil molded part, e.g., materials such as PVC (polyvinyl chloride), PVDC (polyvinylidene chloride), PP (polypropylene), PS (polystyrene), COC (cycloolefin copolymer) and PET (polyester) are suitable.

The cover foil is in particular a push-through foil for a push-through packaging (e.g. a tablet packaging), in which the push-through foil locks the packaged good (e.g. pharmaceutical products, such as tablets) but can be torn open or broken open by pushing through the packaged good. The capability of breaking open can be additionally increased by mechanical impact, e.g., by means of perforations and or cutting grooves and/or thinned regions in the cover foil (which are obtainable, e.g., by means of embossing). The cover foil can be based in particular on a (in particular transparent or semitransparent) carrier substrate provided with the semitransparent function layer. The carrier substrate is in particular a (semi-)transparent plastic material or (semi-) transparent paper. As a carrier substrate there are suitable, e.g., the following materials:

- polyolefin resin; in particular polypropylene or polypropylene having an inorganic filler, the inorganic filler being, e.g., calcium carbonate, talc, aluminum oxide, titanium dioxide, diatomaceous earth, clay, kaolin, chalk, glass fiber or a mixture of two or several of the above-mentioned substances;
- cycloolefin copolymer (COC) or cycloolefin polymer (COP); or films which contain at least one layer of cycloolefin copolymer (COC) or cycloolefin polymer (COP), e.g., films with the structure COC/PE/COC or COC/PP/COC or COC/PE-LLD/COC or a film with a COC core layer (e.g., the following layer sequence: polymeric thermal protection layer (preferably chosen from COC, COP, PP, PA or PET)—COC core layer—polymeric heat seal layer), described in WO 2009/000403 A1 or in WO 2010/139409 A1;
- oriented polyethylene terephthalate (OPET); or an OPET film which with a polyethylene layer or a polypropylene layer is combined into a laminate, and the laminate can have, where applicable, cutting grooves or notches;
- polymer phase containing polyolefin (A), in which a hydrocarbon resin component (B) is contained in dissolved form, the hydrocarbon resin component (B) being different from the polyolefin (A) and comprising cyclic side groups at the polymer chain and being contained with a portion of at least 3 wt-% in the overall mass in the carrier substrate, the average molecular weight of the hydrocarbon resin component (B) being smaller or equal to 10 000; as a polyolefin (A) there are preferred polyethylene, polypropylene or a copolymer or terpolymer of ethylene and/or propylene; component (B) is in particular an amorphous polymer; such push-through foils are known from DE 196 13 960 A1.

The semitransparent function layer is obtainable, e.g., by means of vapor deposition or by printing technology. The semitransparent function layer can have a single-layer or a multi-layer structure. In case of a multi-layer structure it is possible that all layers are produced by means of vapor deposition; alternatively, it is possible that one or several layers are produced by means of vapor deposition and one further or several further layers are produced by printing technology (for example, two semitransparent metallic layers produced by means of vapor deposition and one intermediate dielectric layer based on nitrocellulose and obtainable by printing technology). Furthermore, the semitransparent function layer can be present, e.g., in the form of a continuous coating or be present in the form of a discontinuous coating produced, e.g., from metallic pigments or effect pigments. Concrete examples with regard to the semitransparent function layer are in particular the following layer systems A), B), C) and D):

A) two semitransparent metallic layers and one intermediate dielectric layer;

B) two semitransparent metallic layers and one intermediate color layer, preferably 1 to 2 micrometers thick (e.g. of blue color); preferably, the two semitransparent metallic layers are respectively additionally coated with a further color layer, preferably 1 to 2 micrometers thick, at the outer side, in particular in a complementary color to the color layer arranged between the metallic layers (e.g. in yellow color) (in this manner there arises the following layer structure in a gold/blue color change in a view in incident light or transmitted light: yellow printed layer—semitransparent metallic layer—blue printed layer—semitransparent metallic layer—yellow printed layer); furthermore, e.g., the following layer system comprising the layers a) to c) is possible: a) yellow colored, "silver" mirror layer obtainable by means of yellow colored metal pigments which are known from WO 2005/051675 A2 (the metal pigments are based on a metal which is chosen preferably from the group consisting of aluminum, stainless steel, nichrome, gold, silver, platinum and copper; the metal is particularly preferably aluminum, the average particle diameter being preferably in a range of 8 to 15 μm, further preferably in a range of 9 to 10 μm, measured with a Coulter LS130 laser diffraction granulometer; such a printing ink enables the supply of a "silver" mirror layer), b) blue color layer, preferably 1 to 2 micrometers thick, c) yellow colored, "silver" mirror layer obtainable by means of yellow colored metal pigments which are known from WO 2005/051675 A2 (see the description of layer a));

C) alternatively, the above layer system can be so configured that some of the layers are arranged on the front side of the carrier substrate of the cover foil and some layers are arranged on the back side of the carrier substrate of the cover foil; e.g., the following layer system comprising the layers a) to f) is possible: a) yellow color layer, preferably 1 to 2 micrometers thick, b) semitransparent metallic layer (e.g., aluminum), c) carrier substrate (e.g. (semi-) transparent plastic material), d) blue color layer, preferably 1 to 2 micrometers thick, e) semitransparent metallic layer (e.g. aluminum), f) yellow color layer, preferably 1 to 2 micrometers thick; furthermore, e.g., the following layer system comprising the layers a) to d) is possible: a) yellow colored, "silver" mirror layer obtainable by means of yellow colored metal pigments which are known from WO 2005/051675 A2 (the metal pigments are based on a metal which is chosen preferably from the group consisting of aluminum, stainless steel, nichrome, gold, silver, platinum and copper; the metal is particularly preferably aluminum, the average particle diameter being preferably in a range of 8 to 15 μm, further preferably in a range of 9 to 10 μm, measured with a Coulter LS130 laser diffraction granulometer; such a printing ink enables the supply of a "silver" mirror layer), b) carrier substrate (e.g. (semi-)transparent plastic material), c) blue color layer, preferably 1 to 2 micrometers thick, d) yellow colored, "silver" mirror layer obtainable by means of yellow colored metal pigments which are known from WO 2005/051675 A2 (see the description of layer a));

D) the layer systems mentioned above in B) and C) can, of course, be varied with respect to the yellow color layer and the blue color layer to the effect that different colours are used instead of yellow or blue, which are in particular complementary to each other.

For sealing the plastic foil molded part with the cover foil, the cover foil can have in particular a heat seal lacquer (or heat seal binding agent) which is arranged, where applicable, on the cover foil by means of a heat seal lacquer priming (or adhesion promoter). Instead of the formulation "heat seal binding agent and optionally present adhesion promoter" there is also used the term "heat seal coating" herein.

The cover foil can in particular have visually recognizable markings in the form of patterns, characters or a coding, obtainable by irradiation with laser radiation. The visually recognizable markings here are produced in the semitransparent function layer, in particular in the form of transparent markings which are visible to the viewer both in incident light as well as in transmitted light.

2. (Preferred embodiment) Packaging according to section 1, wherein the packaging is constituted such that a packaged object, e.g. a tablet, is not recognizable upon viewing the back side of the packaging in incident light and is recognizable upon viewing the back side of the packaging in transmitted light in the form of a motif formed by the first, visually recognizable color and the second, visually recognizable color.

3. (Preferred embodiment) Packaging according to section 1 or 2, wherein the semitransparent function layer has a multi-layer structure with two semitransparent metallic layers and a dielectric layer arranged between the two semitransparent metallic layers.

4. (Preferred embodiment) Packaging according to section 3, wherein the two semitransparent metallic layers are formed independently of each other from a metal and the metal is respectively chosen from the group consisting of Al, Ag, Ni, Cr, Cu, Au and an alloy of one or several of the hereinabove mentioned elements and the dielectric layer is an $SiO_2$ layer, a ZnO layer, an $Al_2O_3$ layer, a $TiO_2$ layer, a layer made of a nitride or oxynitride of one of the elements Si, Zn, Al or Ti, or an $MgF_2$ layer, or a nitrocellulose layer obtainable, e.g., by printing technology.

5. (Preferred embodiment) Packaging according to section 4, wherein the two semitransparent metallic layers are chosen from Al or Ag and the dielectric layer is an $SiO_2$ layer.

6. (Preferred embodiment) Packaging according to any of sections 3 to 5, wherein the cover foil appears golden upon viewing in incident light and has a blue color tone upon viewing in transmitted light.

7. (Preferred embodiment) Packaging according to any of sections 1 or 2, wherein the semitransparent function layer is obtainable by printing technology by means of an effect pigment composition.

8. (Preferred embodiment) Packaging according to any of sections 1 to 7, wherein the cover foil additionally has an opaque layer, in particular a printed layer or a metallization, with gaps in the form of patterns, characters or a coding.

9. (Preferred embodiment) Packaging according to any of sections 1 to 8, wherein the plastic foil molded part is opaque, opaque-white or transparent and preferably is transparent.

10. (Preferred embodiment) Packaging according to any of sections 1 to 9, wherein the packaging is a blister, preferably a blister for pharmaceutical products, particularly preferably a tablet packaging or a tablet blister.

11. (Second aspect of the invention) Use of a foil, comprising a (in particular transparent or semitransparent) carrier substrate provided with a semitransparent function layer, wherein the semitransparent function layer is constituted such that the foil has a first, visually recognizable color upon viewing in incident light and has a second, visually recognizable color upon viewing in transmitted light, as a cover foil of a packaging, in particular of a blister, further in particular of a tablet packaging.

12. (Preferred embodiment) Use according to section 11, wherein the semitransparent function layer has a multi-layer structure with two semitransparent metallic layers and a dielectric layer arranged between the two semitransparent metallic layers.

13. (Preferred embodiment) Use according to section 11, wherein the semitransparent function layer is obtainable by printing technology by means of an effect pigment composition.

14. (Preferred embodiment) Use according to any of section 11 to 13, wherein the foil additionally has an opaque layer, in particular a printed layer or a metallization, with gaps in the form of patterns, characters or a coding.

15. (Preferred embodiment) Use according to any of sections 11 to 14, wherein the foil has additional technical features according to any of sections 1 to 8, the repeated description thereof being omitted at this point.

16. (Third aspect of the invention) Cover foil suitable for covering a blister, in particular a tablet packaging, comprising a carrier substrate provided with a semitransparent function layer, wherein the semitransparent function layer is constituted such that the foil has a first, visually recognizable color upon viewing in incident light and has a second, visually recognizable color upon viewing in transmitted light. The cover foil can be present in particular in the form of an endless foil.

17. (Preferred embodiment) Cover foil according to section 16, wherein the semitransparent function layer has a multi-layer structure with two semitransparent metallic layers and a dielectric layer arranged between the two semitransparent metallic layers.

18. (Preferred embodiment) Cover foil according to section 16, wherein the semitransparent function layer is obtainable by printing technology by means of an effect pigment composition.

19. (Preferred embodiment) Cover foil according to any of sections 16 to 18, wherein the foil additionally has an opaque layer, in particular a printed layer or a metallization, with gaps in the form of patterns, characters or a coding.

20. (Preferred embodiment) Cover foil according to any of sections 16 to 19, wherein the cover foil has additional technical features according to any of sections 1 to 8, the repeated description thereof being omitted at this point.

DETAILED DESCRIPTION OF THE INVENTION

A viewing in incident light, according to this invention, is an illumination of the respective object from one side and a viewing of the object from the same side. A viewing in incident light is thus present for example when the back side of the packaging is illuminated and also viewed.

A viewing in transmitted light, according to this invention, is an illumination of the respective object from one side and a viewing of the object from the opposite side. A viewing in transmitted light is thus present for example when the front side of the packaging is illuminated and the back side of the packaging is viewed. The light thus shines at least partly through the packaging.

The packaging according to the invention is characterized in that it has a semitransparent cover foil with a color change upon viewing in incident light (reflection), on the one hand, and upon viewing in transmitted light (transmission), on the other hand. Since an object contained, e.g., in a cavity of the plastic molded part of the packaging, e.g. a tablet, lowers the light transmission, the viewer perceives the object upon viewing the packaging and looking onto the cover foil in transmitted light substantially in the reflection color of the cover foil. The region of the cover foil lying outside the object appears to the viewer in the transmission color of the cover foil.

The quick and uncomplicated discovering of the object contained in the packaging is advantageous in particular in the case of a pharmaceutical product, as for example a tablet, e.g., as a life-saving immediate action or in the case of a disturbance of consciousness of the consumer by the influence of alcohol, influence of a disease or shock state.

In addition, the tablet packaging of the invention is particularly advantageous as a result of its elevated forgery resistance, because semitransparent cover foils with color change upon viewing in incident light, on the one hand, and upon viewing in transmitted light, on the other hand, are relatively hard to access for the forger. In addition, an uncomplicated authenticity check of the tablet packaging of the invention can be performed without additional technical aids by the consumer, also when the consumer is a child, by viewing the tablet packaging and looking onto the cover foil in incident light and in transmitted light.

For increasing the protection from forgery, the cover foil can be equipped with additional anti-forgery means, e.g.

- the supply of an additional opaque coating, in particular a printed layer or a metallization which has gaps in the form of patterns, characters or a coding;
- the printing of the cover foil with (micro)writing, in particular with effect pigments;
- the supply of luminescent or magnetic security features which are detectable in particular by machine;
- the supply of an additional hologram, in particular an embossing lacquer layer with a diffractive relief structure which is provided, where applicable, with a metallization;
- the supply of a microoptical relief structure, in particular a micromirror arrangement; the production of a microoptical relief structure is known in the prior art (see e.g. WO 2014/060089 A2);
- the supply of an additional paper layer which, where applicable, has gaps or watermarks (e.g. producible by means of punching or laser cutting);
- the treatment of the cover foil with laser radiation in order to produce in this way visually recognizable markings in the form of patterns, characters or a coding in the semitransparent function layer; such a laser treatment can also be effected in the form of a final processing step on a finished blister packaging to provide the cover foil, e.g., with a (e.g. two-dimensional) bar code; by means of the laser treatment there can also be produced one marking per tablet, in particular a coding, in the cover foil; as a laser there is suitable, e.g., an Nd:YAG laser (neodymium-doped yttrium aluminum garnet laser), i.e. solid state laser which uses a neodymium-doped YAG crystal as an active medium and emits mostly infrared radiation with the wavelength 1064 nm; the treatment of the cover foil with laser radiation leads, e.g., to the supply of transparent markings in the semitransparent function layer which are visible to the viewer in incident light as well as in transmitted light.

In addition, the cover foil can be equipped with RFID antennas or RFID tags.

With regard to its material constitution the cover foil can be configured such that its mechanical and/or optical state as a result of oxidative processes or through humidity influence serves as a durability proof for the consumer. Thus, e.g. the semitransparent function layer may contain a metal which changes optically through the influence of oxygen and or humidity.

For sealing the plastic foil molded part with the cover foil, the cover foil can have in particular a heat seal coating, e.g., a heat seal binding agent (herein also referred to as a heat seal lacquer) which is arranged on the cover foil by means of an optionally present adhesion promoter (herein also referred to as a heat seal lacquer priming). For drug blister packagings there is suitable, e.g., a combination of a PVC-based adhesion promoter and the heat seal binding agent with the trade name "DEGALAN® P24" commercially available from the Evonik company. For drug blister packagings there is also suitable, e.g., the heat seal binding agent with the trade name "DEGALAN® VP P34" based on hot-sealing-capable pearl polymers, commercially available from the Evonik company, for which a preceding priming with an adhesion promoter is not necessary.

The cover foil can have, e.g., a thickness in the range of 5 micrometers to 100 micrometers, preferably 5 micrometers to 60 micrometers, further preferably in the range of 10 micrometers to 30 micrometers, more preferably in the range of 15 micrometers to 25 micrometers.

For manufacturing the plastic foil molded part, e.g., materials such as PVC (polyvinyl chloride), PVDC (polyvinylidene chloride), PP (polypropylene), PS (polystyrene), COC (cycloolefin copolymer) and PET (polyester) are suitable. The shaping can be effected by means of thermoforming technology.

The cover foil can be based in particular on a (in particular transparent or semitransparent) carrier substrate provided with the semitransparent function layer. The carrier substrate is in particular a (semi-)transparent plastic material or (semi-)transparent paper. As a carrier substrate there are suitable, e.g., the following materials:

- polyolefin resin; in particular polypropylene or polypropylene having an inorganic filler, the inorganic filler being, e.g., calcium carbonate, talc, aluminum oxide, titanium dioxide, diatomaceous earth, clay, kaolin, chalk, glass fiber or a mixture of two or several of the above-mentioned substances; by the additional incorporation of inorganic fillers the mechanical properties of the carrier substrate, such as the stiffness, can be adjusted; the filler portion in the carrier substrate is preferably 30 wt-% to 60 wt-%; the average particle size of the inorganic filler is preferably 0.1 micrometer to 50 micrometers; with rising filler content the opacity of the carrier substrate increases, hence, a too high filler content is not preferred;
- cycloolefin copolymer (COC) or cycloolefin polymer (COP); or films which contain at least one layer of cycloolefin copolymer (COC) or cycloolefin polymer (COP), e.g., films with the structure COC/PE/COC or COC/PP/COC or COC/PE-LLD/COC or a film with a COC core layer (e.g., the following layer sequence: polymeric thermal protection layer (preferably chosen from COC, COP, PP, PA or PET)—COC core layer—polymeric heat seal layer), described in WO 2009/000403 A1 or in WO 2010/139409 A1 (the abbreviation PE-LLD stands for linear polyethylene of low density);
- oriented polyethylene terephthalate (OPET); or an OPET film which with a polyethylene layer or a polypropylene layer is combined into a laminate, and the laminate can have, where applicable, cutting grooves or notches; cutting grooves or notches can be incorporated by means of a knife or by means of laser radiation;
- oriented plastic film containing a polyethylene-2,6-naphthalate-resin as a main component;
- uniaxially oriented polypropylene film irradiated with ionising radiation;
- oriented polyethylene terephthalate film (OPET film) coated with a polyester anchor coating agent and a PE layer;
- oriented polyethylene terephthalate film (OPET film) coated with a polyethylene anchor coating agent and a PP layer;
- porous plastic film (e.g., polyethylene terephthalate film or polypropylene film) which for covering the small pores is coated with a molten resin (e.g. olefin resin, such as a polyethylene resin or a polypropylene resin);
- polymer phase containing polyolefin (A), in which a hydrocarbon resin component (B) is contained in dissolved form, the hydrocarbon resin component (B) being different from the polyolefin (A) and comprising cyclic side groups at the polymer chain and being contained with a portion of at least 3 wt-% in the overall mass in the carrier substrate, the average molecular weight of the hydrocarbon resin component (B) being smaller or equal to 10 000; as a polyolefin (A) there are preferred polyethylene, polypropylene or a copolymer or terpolymer of ethylene and/or propylene; component (B) is in particular an amorphous polymer; such push-through foils are known from DE 196 13 960 A1.

The semitransparent function layer has different color tones upon viewing in incident light, on the one hand, and upon viewing in transmitted light, on the other hand. The two different color tones are e.g. complementary colours. Such a semitransparent function layer is based e.g. on a multi-layer structure with two semitransparent metallic layers and a dielectric layer arranged between the two semitransparent metallic layers. Such a multi-layer structure which upon viewing in incident light appears golden and upon viewing in transmitted light shows a blue color tone is known e.g. from WO 2011/082761 A1. Moreover, WO 2011/032665 A1 describes similar multi-layer structures.

Suitable multi-layer structures with two semitransparent metallic layers and a dielectric layer arranged between the two semitransparent metallic layers preferably have the following material constitution:

- the two semitransparent metallic layers are chosen preferably from Al or Ag; the dielectric layer is in particular an $SiO_2$ layer or an $MgF_2$ layer, preferably an $SiO_2$ layer;
- if each of the two semitransparent metallic layers is based on Al, the respectively preferred coating thickness is in a range of 5 nm to 20 nm, particularly preferably in a range of 10 nm to 14 nm; the dielectric $SiO_2$ layer preferably has a coating thickness in a range of 50 nm to 450 nm, further preferably in a range of 80 nm to 260 nm and particularly preferably in a range of 210 nm to 260 nm, the ranges from 80 nm to 100 nm and from 210 nm to 240 nm being particularly preferred for the supply of a gold/blue color change;
- if each of the two semitransparent metallic layers is based on Ag, the respectively preferred coating thickness is in a range of 15 nm to 30 nm, particularly preferably from 15 nm to 25 nm; the dielectric $SiO_2$ layer preferably has a coating thickness in a range of 50 nm to 450 nm, further preferably in a range of 80 nm to 260 nm and particularly preferably in a range of 210 nm to 260 nm, the ranges from 80 nm to 100 nm and from 210 nm to 240 nm being particularly preferred for the supply of a gold/blue color change.

The above-mentioned multi-layer structures with two semitransparent metallic layers and a dielectric layer arranged between the two semitransparent metallic layers can have a symmetrical three-layer structure, in which both the material and the coating thickness of the two semitransparent metallic layers are identical. Alternatively, however, there can also be present an asymmetrical three-layer structure, in which the material and/or the coating thickness of the two semitransparent metallic layers are different, e.g.

- a silver/dielectric/aluminum layer system in which the coating thicknesses of the silver layer and of the aluminum layer are identical or different;
- a silver/dielectric/silver layer system in which the coating thicknesses of the two silver layers are different;
- an aluminium/dielectric/aluminum layer system in which the coating thicknesses of the two aluminum layers are different.

The above-mentioned multi-layer layer structures do not only make possible the production of a semitransparent function layer which appears golden upon viewing in incident light and upon viewing in transmitted light shows a blue color tone, but there can also be produced, depending on the choice of the coating thickness in particular of the dielectric layer, further color changes, e.g.

- in incident light magenta, in transmitted light blue-green;
- in incident light turquoise, in transmitted light orange-yellow;
- in incident light golden, in transmitted light blue-violet;
- in incident light silver, in transmitted light violet.

A pharmaceutical manufacturer can utilize the different, above-mentioned color changes for the supply of its drugs in the form of different tablet packagings according to a defined color coding, e.g. the following color coding being conceivable:

- headache tablets: tablet packaging with a cover foil which appears golden in incident light and blue in transmitted light;
- tablets against stomach-ache: tablet packaging with a cover foil which appears turquoise in incident light and orange-yellow in transmitted light;
- sleeping tablets: tablet packaging with a cover foil which appears magenta in incident light and blue-green in transmitted light.

In case of disturbance of consciousness, the above color coding enables the consumer to avoid, e.g., the inadvertent intake of tablets against stomach-ache instead of headache tablets.

A semitransparent function layer, which has different color tones upon viewing in incident light, on the one hand, and upon viewing in transmitted light, on the other hand, can further be based on an effect pigment composition. Printed layers on the basis of an effect pigment composition which upon viewing in incident light shows a different color than upon viewing in transmitted light, in particular a gold/blue color change, a gold/violet color change, a green-gold/magenta color change, violet/green color change or a silver/opaque color change are described, e.g., in WO 2011/064162 A2. The pigments preferably have a longest dimension ("longest dimension of edge length") from end to end in a range of 15 nm to 1000 nm and are based on a transition metal which is chosen from the group consisting of Cu, Ag, Au, Zn, CD, Ti, Cr, Mn, Fe, Co, Ni, Ru, Rh, Pd, Os, Ir, and Pt. The transition metal is preferably Ag. The aspect ratio (i.e. the ratio of the longest dimension from end to end in relation to the thickness) is preferably at least 1.5, in particular in a range of 1.5 to 300. The ratio of binding agent and metal pigment is preferably below 10:1, in particular below 5:1. In dependence on the choice of the aspect ratio of the pigment, its longest dimension from end to end and the adjustment of the ratio of pigment/binding agent, the color upon viewing the printed layer in transmission and the color upon viewing in reflection can be adjusted (e.g. blue in transmission and silver, gold, bronze, copper or violet in reflection; moreover, also violet, magenta, pink, green or brown in transmission and various colours in reflection which depend on the choice of the ratio of pigment/binding agent). Colours with gold/blue color change between reflection and transmission (in other words, between viewing in incident light and in transmitted light) are stated, e.g., in the Examples 1, 2 and 3 in Table 1 of WO 2011/064162 A2. Furthermore, Example 4 shows a color with gold/violet color change, Example 5 a color with green-gold/magenta color change, Example 7 a color with violet/green color change and Example 8 a color with silver/opaque color change.

A pharmaceutical manufacturer can utilize the different, above-mentioned color changes for the supply of its drugs in the form of different tablet packagings according to a defined color coding, e.g. the following color coding being conceivable:

- headache tablets: tablet packaging with a cover foil which appears golden in incident light and blue in transmitted light;
- tablets against stomach-ache: tablet packaging with a cover foil which appears green-gold in incident light and magenta in transmitted light;
- sleeping tablets: tablet packaging with a cover foil which appears violet in incident light and green in transmitted light.

In case of disturbance of consciousness, the above color coding enables the consumer to avoid, e.g., the inadvertent intake of tablets against stomach-ache instead of headache tablets.

A semitransparent function layer which upon viewing in incident light, on the one hand, and upon viewing in transmitted light, on the other hand, has different color tones, furthermore, can be based at least partly on the use of conventional color layers or color lacquers and be constituted according to one of the following variants:

1) two semitransparent metallic layers (e.g. 5 nm to 15 nm Al) and one intermediate color layer, preferably 1 to 2 micrometers thick (e.g. of blue color); preferably, the two semitransparent metallic layers are respectively additionally coated with a further color layer, preferably 1 to 2 micrometers thick, at the outer side, in particular in a complementary color to the color layer arranged between the metallic layers (e.g. in yellow color) (in this manner there arises the following layer structure in a gold/blue color change in a view in incident light or transmitted light: yellow printed layer—semitransparent metallic layer—blue printed layer—semitransparent metallic layer—yellow printed layer); furthermore, e.g., the following layer system comprising the layers a) to c) is possible: a) yellow colored, "silver" mirror layer obtainable by means of yellow colored metal pigments which are known from WO 2005/051675 A2 (the metal pigments are based on a metal which is chosen preferably from the group consisting of aluminum, stainless steel, nichrome, gold, silver, platinum and copper; the metal is particularly preferably aluminum, the average particle diameter being preferably in a range of 8 to 15 μm, further preferably in a range of 9 to 10 μm, measured with a Coulter LS130 laser diffraction granulometer; such a printing ink enables the supply of a "silver" mirror layer), b) blue color layer, preferably 1 to 2 micrometers thick, c) yellow colored, "silver" mirror layer obtainable by means of yellow colored metal pigments which are known from WO 2005/051675 A2 (see the description of layer a));

2) alternatively, the above layer system can be so configured that some of the layers are arranged on the front side of the carrier substrate of the cover foil and some layers are arranged on the back side of the carrier substrate of the cover foil; e.g., the following layer system comprising the layers a) to f) is possible: a) yellow color layer, preferably 1 to 2 micrometers thick, b) semitransparent metallic layer (e.g. 5 nm to 15 nm aluminum), c) carrier substrate (e.g. (semi-) transparent plastic material), d) blue color layer, preferably 1 to 2 micrometers thick, e) semitransparent metallic layer (e.g. 5 nm to 15 nm aluminum), f) yellow color layer, preferably 1 to 2 micrometers thick; furthermore, e.g., the following layer system comprising the layers a) to d) is possible: a) yellow colored, "silver" mirror layer obtainable by means of yellow colored metal pigments which are known from WO 2005/051675 A2 (the metal pigments are based on a metal which is chosen preferably from the group consisting of aluminum, stainless steel, nichrome, gold, silver, platinum and copper; the metal is particularly preferably aluminum, the average particle diameter being preferably in a range of 8 to 15 μm, further preferably in a range of 9 to 10 μm, measured with a Coulter LS130 laser diffraction granulometer; such a printing ink enables the supply of a "silver" mirror layer), b) carrier substrate (e.g. (semi-)transparent plastic material), c) blue color layer, preferably 1 to 2 micrometers thick, d) yellow colored, "silver" mirror layer obtainable by means of yellow colored metal pigments which are known from WO 2005/051675 A2 (see the description of layer a));

3) the layer systems mentioned above in 1) and 2) can, of course, be varied with respect to the yellow color layer and the blue color layer to the effect that different colours are used instead of yellow or blue, which are in particular complementary to each other.

A cover foil utilizable for the tablet packaging according to the invention can have, e.g., the following multi-layer structure:

- primer layer or protective lacquer (optional, i.e. not compulsory; the primer layer can be in particular an ink-receiving layer which is suitable for being printed with printing ink; in this manner the printability of the cover foil with writing (e.g. manufacturer and trade name of a drug) can be further improved);
- carrier substrate, e.g. polypropylene, which is equipped, where applicable, with inorganic fillers;
- semitransparent function layer (e.g. $Al/SiO_2/Al$ layer sequence or $Ag/SiO_2/Ag$ layer sequence, in particular with gold/blue color change in incident light/transmitted light viewing);
- heat seal lacquer priming (optional);
- heat seal lacquer (directed to the plastic foil molded part).

The order of the above layers can be varied, where applicable. The semitransparent function layer can thus be present, e.g., between the primer layer and the carrier substrate.

A further cover foil utilizable for the tablet packaging according to the invention can have, e.g., the following multi-layer structure:

- primer layer (optional);
- a paper layer;
- carrier substrate, e.g. polypropylene, which is equipped, where applicable, with inorganic fillers;
- semitransparent function layer (e.g. $Al/SiO_2/Al$ layer sequence or $Ag/SiO_2/Ag$ layer sequence, in particular with gold/blue color change in incident light/transmitted light viewing);
- heat seal lacquer priming (optional);
- heat seal lacquer (directed to the plastic foil molded part).

In the above example, the cover foil includes as a supporting layer an additional paper layer in its multi-layer structure. The additional paper layer gives additional strength to the cover foil. The order of the layers in the above multi-layer structure can be varied, e.g., the semitransparent function layer can be present between the paper layer and the carrier substrate. For an improved perceptibility of the incident light/transmitted light color change, the paper can be configured to be transparent (e.g. by a preceding treatment with chemical reagents, such as sulfuric acid). Alternatively or additionally, the paper can be partly omitted, e.g., by means of punching or laser cutting. Also deckle edge holes or watermarks (which are respectively obtainable, e.g., by means of cylinder paper manufacturing) can be supplied in the paper layer as additional anti-forgery means.

A further cover foil utilizable for the tablet packaging according to the invention can have, e.g., the following multi-layer structure:

- primer layer (optional);
- an opaque layer, in particular a printed layer or a metallization, with gaps in the form of patterns, characters or a coding;
- carrier substrate, e.g. polypropylene, which is equipped, where applicable, with inorganic fillers;
- semitransparent function layer (e.g. $Al/SiO_2/Al$ layer sequence or $Ag/SiO_2/Ag$ layer sequence, in particular with gold/blue color change in incident light/transmitted light viewing);
- heat seal lacquer priming (optional);
- heat seal lacquer (directed to the plastic foil molded part).

The order of the above layers can be varied, where applicable. Thus, the semitransparent function layer can be present, e.g., between the opaque layer and the carrier substrate. Or the opaque layer can be present between the carrier substrate and the semitransparent function layer.

BRIEF DESCRIPTION OF THE DRAWINGS

Further embodiment examples as well as advantages of the invention will be explained hereinafter with reference to the strongly simplified Figures, in whose representation a rendition that is true to scale and to proportion has been dispensed with in order to increase the clearness.

There are shown.

DETAILED DESCRIPTION OF VARIOUS EMBODIMENTS

FIGS. 1 to 4 illustrate the mode of function of a packaging of the invention according to a first embodiment example.

The packaging in the present example is described with reference to a tablet packaging.

Figure 1:
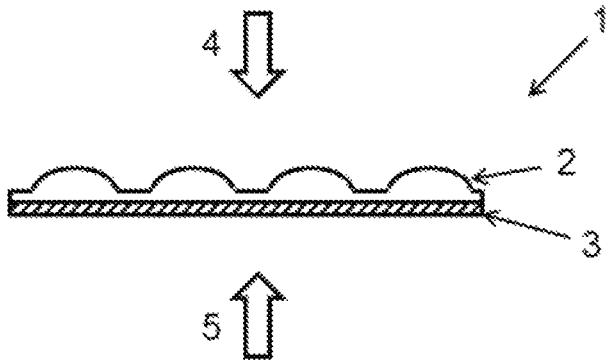
FIGS. 1 to 4 a packaging of the invention according to a first embodiment example.

FIG. 1 shows a tablet packaging 1 which comprises an opaque-white plastic foil molded part 2, e.g. manufactured from PVC, and a cover foil 3. The block arrow 4 symbolizes the viewing of the tablet packaging 1 from the front side, the block arrow 5 symbolizes the viewing of the tablet packaging 1 from the back side. The cover foil 3 has the following structure:

primer layer (directed toward the viewer);
carrier substrate (polypropylene);
semitransparent function layer (20 nm Ag/240 nm $SiO_2$/20 nm Ag) with gold/blue color change in incident light/transmitted light viewing;
heat seal lacquer priming;
heat seal lacquer (directed to the plastic foil molded part 2).

Figure 2:
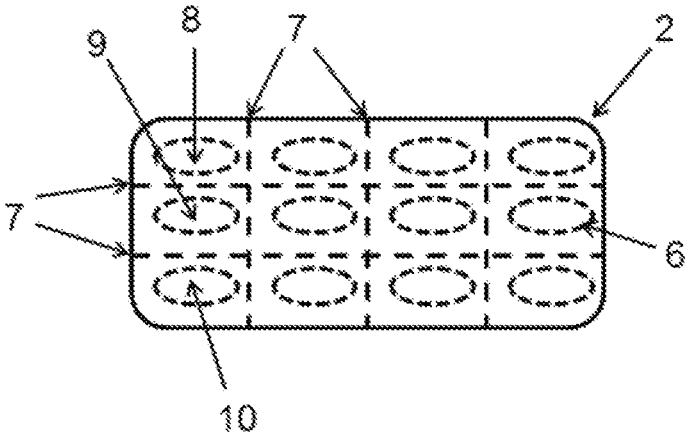

FIG. 2 shows the front side of the tablet packaging 1. The viewer perceives the opaque-white plastic foil molded part 2 in a uniform, white color. With the reference sign 6 the bubbles (or cavities or depressions) are indicated in dashed form in the plastic foil molded part 2. With the reference sign 7 present perforations, if any, are represented. From the tablet packaging 1 there were already taken out nine tablets by the consumer. Consequently, there are only three tablets left, which are present in the cavities 8, 9 and 10 and are not visible to the viewer because of the opaque-white plastic foil molded part 2.

In the shown example, the cover foil 3 in the region of the removed tablets is partially severed, but is substantially still present.

Figure 3:
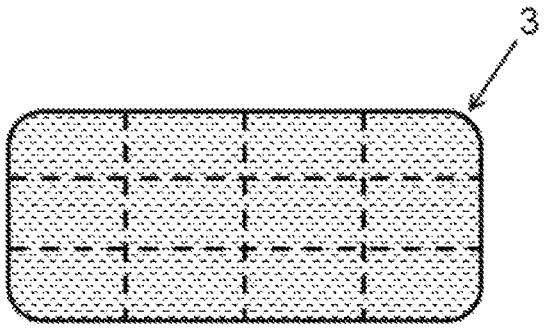

FIG. 3 shows the back side of the tablet packaging 1 (i.e. the cover foil 3) upon viewing in incident light. The viewer perceives the cover foil 3 in the form of a homogeneous, golden metallization.

Figure 4:
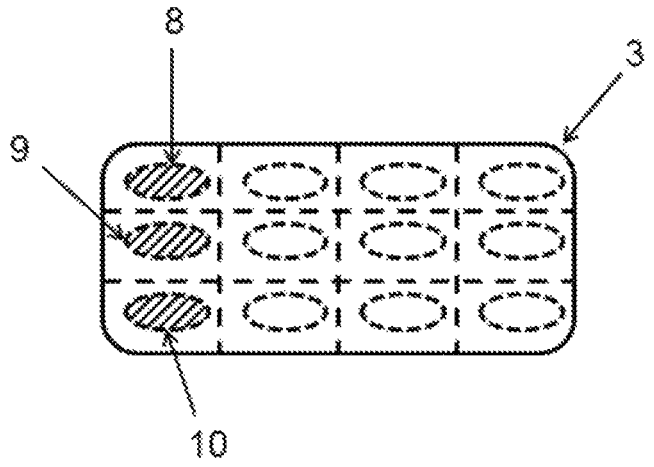

FIG. 4 shows the back side of the tablet packaging 1 (i.e. the cover foil 3) upon viewing in transmitted light. The viewer perceives the three still present tablets in the cavities 8, 9 and 10 three-dimensionally in a dark gold. The remaining part of the cover foil 3 appears to the viewer in a bright gold which has a bluish color portion.

FIGS. 5 to 8 illustrate the mode of function of a packaging of the invention according to a second embodiment example. The packaging in the present example is described with reference to a tablet packaging.

Figure 5:
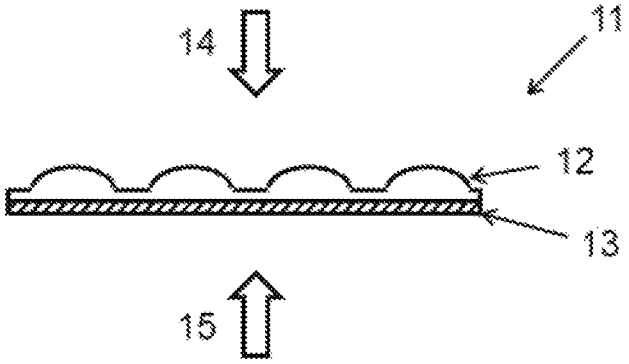
FIGS. 5 to 8 a packaging of the invention according to a second embodiment example.

FIG. 5 shows a tablet packaging 11 which comprises a transparent plastic foil molded part 12 and a cover foil 13. The block arrow 14 symbolizes the viewing of the tablet packaging 11 from the front side, the block arrow 15 symbolizes the viewing of the tablet packaging 11 from the back side. The cover foil 13 has the following structure:

primer layer (directed toward the viewer);
carrier substrate (polypropylene);
semitransparent function layer (20 nm Ag/240 nm $SiO_2$/20 nm Ag) with gold/blue color change in incident light/transmitted light viewing;
heat seal lacquer priming;
heat seal lacquer (directed to the plastic foil molded part 12).

Figure 6:
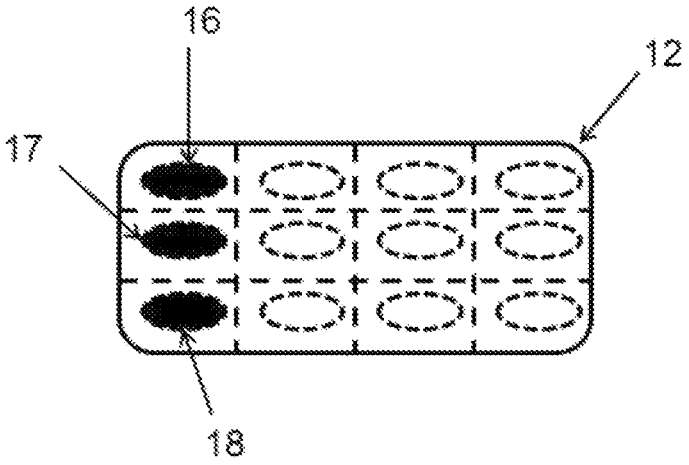

FIG. 6 shows the front side of the tablet packaging 11. The viewer sees the three tablets 16, 17 and 18 still present in the tablet packaging. All the other tablets were already removed from the tablet packaging by the consumer, and although the cover foil 13 in the region of the removed tablets is severed, it is substantially still present. The viewer perceives the cover foil 13 through the transparent plastic foil molded part 12 as a background for the tablets 16, 17 and 18 in the form of a homogeneous, golden metallization.

Figure 7:
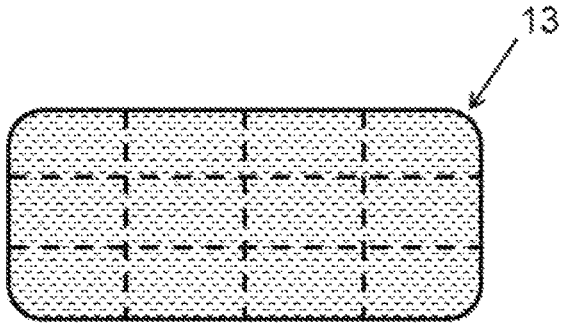

FIG. 7 shows the back side of the tablet packaging 11 (i.e. the cover foil 13) upon viewing in incident light. The viewer perceives the cover foil 13 in the form of a homogeneous, golden metallization.

Figure 8:
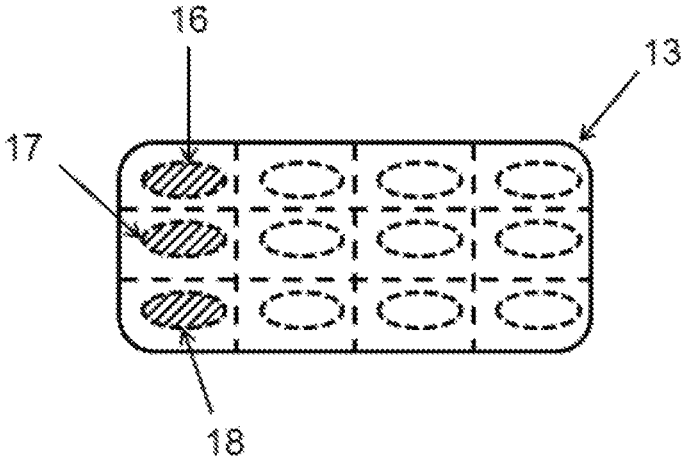

FIG. 8 shows the back side of the tablet packaging 11 (i.e. the cover foil 13) upon viewing in transmitted light. The viewer perceives the three still present tablets 16, 17 and 18 three-dimensionally golden-metallic. The remaining part of the cover foil 13 appears to the viewer in a bright blue, the shaping and the cavities of the plastic foil molded part 12 being readily recognizable three-dimensionally.

FIGS. 9 to 13 illustrate the mode of function of a packaging of the invention according to a third embodiment example. The packaging in the present example is described with reference to a tablet packaging.

Figure 9:
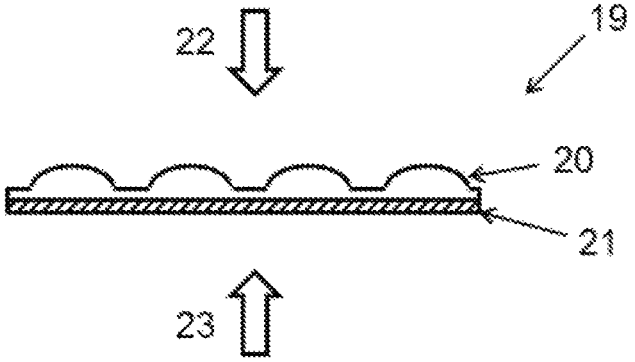
FIGS. 9 to 13 a packaging of the invention according to a third embodiment example.
Figure 11:
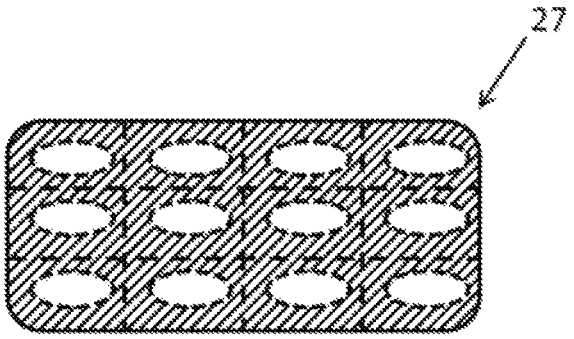

FIG. 9 shows a tablet packaging 19 which comprises a transparent plastic foil molded part 20 and a cover foil 21. The block arrow 22 symbolizes the viewing of the tablet packaging 19 from the front side, the block arrow 23 symbolizes the viewing of the tablet packaging 19 from the back side. The cover foil 21 has the following structure:

primer layer (directed toward the viewer);
opaque, golden metallization with gaps (see the metallization 27 with gaps in the form of the cavities contained in the plastic foil molded part 20, shown in FIG. 11);
carrier substrate (polypropylene);
semitransparent function layer (20 nm Ag/240 nm $SiO_2$/20 nm Ag) with gold/blue color change in incident light/transmitted light viewing;
heat seal lacquer priming;
heat seal lacquer (directed to the plastic foil molded part 20).

Figure 10:
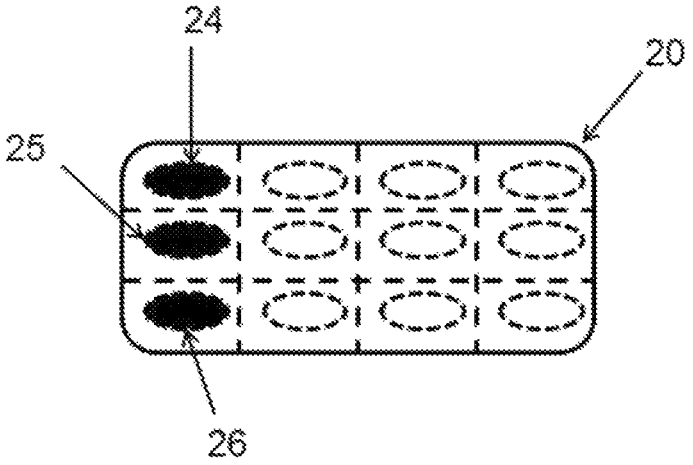

FIG. 10 shows the front side of the tablet packaging 19. The viewer sees the three tablets 24, 25 and 26 still present in the tablet packaging. All the other tablets were already removed from the tablet packaging by the consumer, and although the cover foil 21 in the region of the removed tablets is severed, it is substantially still present. The viewer perceives the cover foil 21 through the transparent plastic foil molded part 20 as a background for the tablets 24, 25 and 26 in the form of a homogeneous, golden metallization.

Figure 12:
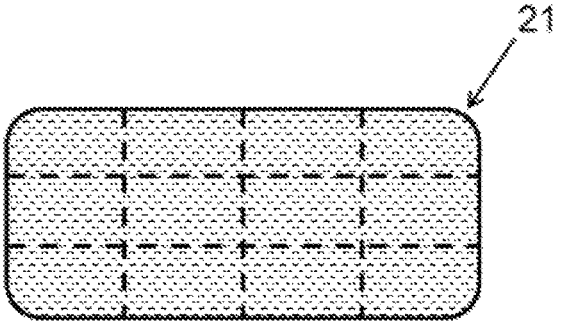

FIG. 12 shows the back side of the tablet packaging 19 (i.e. the cover foil 21) upon viewing in incident light. The viewer perceives the cover foil 21 in the form of a homogeneous, golden metallization.

Figure 13:
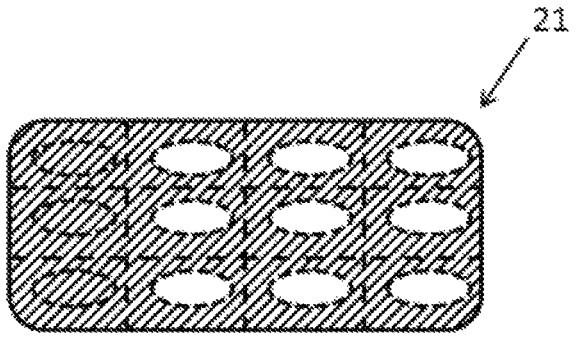

FIG. 13 shows the back side of the tablet packaging 19 (i.e. the cover foil 21) upon viewing in transmitted light. As a result of the additional presence of the opaque, golden metallization 27 according to FIG. 11 within the layer structure of the cover foil 21, the viewer perceives merely the region of the tablet packaging 19 where tablets were already removed in a bright blue, the shaping and the cavities of the plastic foil molded part 20 being readily three-dimensionally recognizable. The rest of the cover foil 21 appears to the viewer homogeneously in the form of a golden, metallic area.

FIGS. 14 to 18 illustrate the mode of function of a packaging of the invention according to a fourth embodiment example. The packaging in the present example is described with reference to a tablet packaging.

Figure 14:
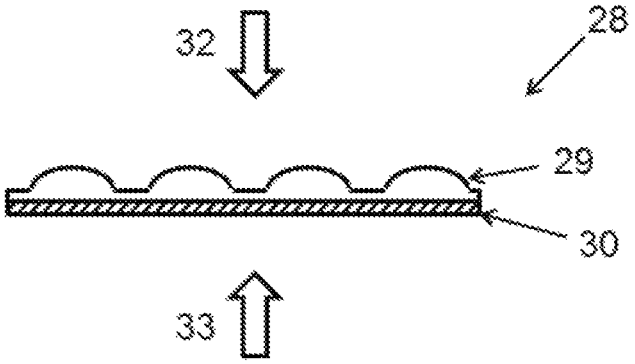
FIGS. 14 to 18 a packaging of the invention according to a fourth embodiment example.
Figure 16:
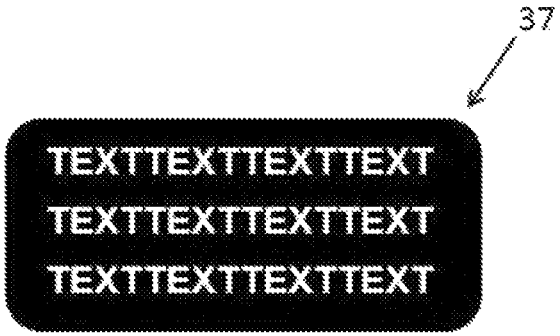

FIG. 14 shows a tablet packaging 28 which comprises a transparent plastic foil molded part 29 and a cover foil 30. The block arrow 32 symbolizes the viewing of the tablet packaging 28 from the front side, the block arrow 33 symbolizes the viewing of the tablet packaging 28 from the back side. The cover foil 30 has the following structure:

primer layer (directed toward the viewer);

opaque, golden metallization with gaps (so-called negative writing; see the metallization 37 with gaps in the form of capitals "TEXTTEXTTEXTTEXT", shown in FIG. 16);

carrier substrate (polypropylene);

semitransparent function layer (20 nm Ag/240 nm $SiO_2$/20 nm Ag) with gold/blue color change in incident light/transmitted light viewing;

heat seal lacquer priming;

heat seal lacquer (directed to the plastic foil molded part 29).

Figure 15:
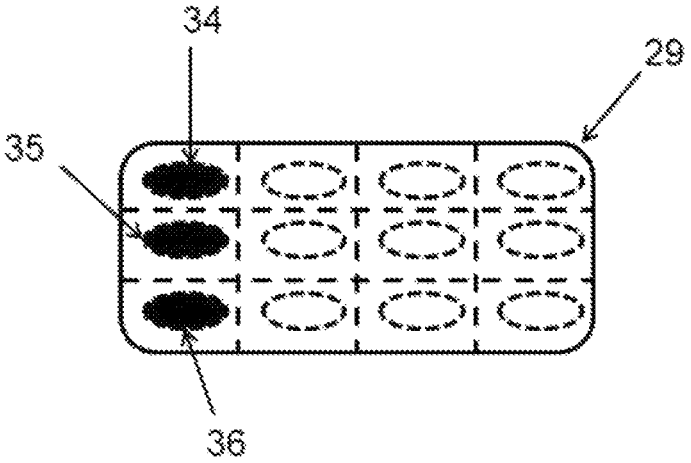

FIG. 15 shows the front side of the tablet packaging 28. The viewer sees the three tablets 34, 35 and 36 still present in the tablet packaging. All the other tablets were already removed from the tablet packaging by the consumer, and although the cover foil 30 in the region of the removed tablets is severed, it is substantially still present. The viewer perceives the cover foil 30 through the transparent plastic foil molded part 29 as a background for the tablets 34, 35 and 36 in the form of a homogeneous, golden metallization.

Figure 17:
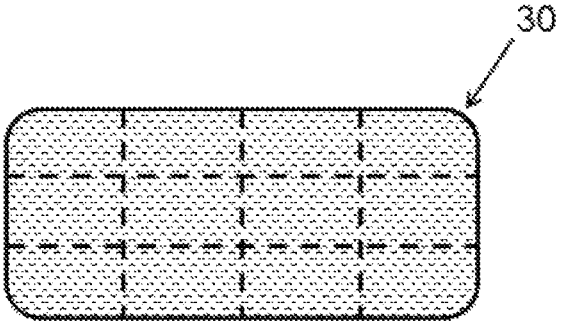

FIG. 17 shows the back side of the tablet packaging 28 (i.e. the cover foil 30) upon viewing in incident light. The viewer perceives the cover foil 30 in the form of a homogeneous, golden metallization.

Figure 18:
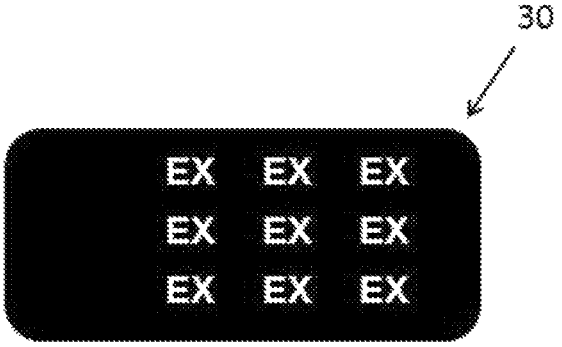

FIG. 18 shows the back side of the tablet packaging 28 (i.e. the cover foil 30) upon viewing in transmitted light. As a result of the additional presence of the opaque, golden metallization 37 with gaps (so-called negative writing) according to FIG. 16 within the layer structure of the cover foil 30, the viewer perceives merely the region of the tablet packaging 28 where tablets were already removed in a bright blue in the shape of the letters "EX". The rest of the cover foil 30 appears to the viewer homogeneously in the form of a golden, metallic area.

A fifth embodiment example (not shown in the Figures) is based on the above second embodiment example. The cover foil with gold/blue color change upon incident light/transmitted light viewing has the following structure:

primer layer (directed toward the viewer);

yellow colored, "silver" mirror layer obtainable by means of yellow colored metal pigments which are known from WO 2005/051675 A2 (the metal pigments are based on a metal which is chosen preferably from the group consisting of aluminum, stainless steel, nichrome, gold, silver, platinum and copper; the metal is in particular preferably aluminum, the average particle diameter being preferably in a range of 8 to 15 μm, further preferably in a range of 9 to 10 μm, measured with a Coulter LS130 laser diffraction granulometer; such a printing ink enables the supply of a "silver" mirror layer);

carrier substrate (polypropylene);

blue color layer;

yellow colored, "silver" mirror layer obtainable by means of yellow colored metal pigments which are known from WO 2005/051675 A2;

heat seal lacquer priming;

heat seal lacquer (directed to the plastic foil molded part).

A sixth embodiment example (not shown in the Figures) is based on the above second embodiment example. The cover foil with gold/blue color change upon incident light/transmitted light viewing has the following structure:

primer layer (directed toward the viewer);

yellow color layer;

semitransparent metallic layer, e.g., Al;

carrier substrate (polypropylene);

blue color layer;

semitransparent metallic layer, e.g., Al;

yellow color layer;

heat seal lacquer priming;

heat seal lacquer (directed to the plastic foil molded part).

A seventh embodiment example (not shown in the Figures) is based on the above second embodiment example. The cover foil with gold/blue color change upon incident light/transmitted light viewing has the following structure:

primer layer (directed toward the viewer);

carrier substrate (polypropylene);

semitransparent function layer (e.g., Ag/$SiO_2$/Ag structure or Al/$SiO_2$/Al structure) with gold/blue color change in incident light/transmitted light viewing;

heat seal lacquer priming;

heat seal lacquer (directed to the plastic foil molded part).

The above cover foil was applied by means of hot sealing onto a plastic foil molded part in whose little cells tablets were contained, in order to produce a tablet packaging in this manner. Into the cover foil of the tablet packaging there was subsequently incorporated a two-dimensional bar code by irradiation by means of a Nd:YAG laser. The laser radiation effects here a change of the semitransparent function layer (probably an ablation or evaporization of the metal), so that in the semitransparent function layer there is produced a transparent marking in the form of a two-dimensional bar code visible to the viewer in incident light as well as in transmitted light.

The primer layer used in the above embodiment examples can be in particular an ink-receiving layer which is suitable for being printed with printing ink. In this manner, the printability of the cover foil with writing (e.g. manufacturer and trade name of a drug) can be further improved.

The heat seal lacquer priming used in the above embodiment examples is optional.

The carrier substrate on a polypropylene basis used in the above embodiment examples may contain inorganic fillers to improve the push-through property of the cover foil. However, the carrier substrate may also be based on other materials, e.g., on cycloolefin copolymer (COC) or cycloolefin polymer (COP), or on films which contain at least one layer of cycloolefin copolymer (COC) or cycloolefin polymer (COP), e.g., films with the structure COC/PE/COC or COC/PP/COC or COC/PE-LLD/COC or a film with a COC core layer (e.g., the following layer sequence: polymeric thermal protection layer (preferably chosen from COC, COP, PP, PA or PET)—COC core layer—polymeric heat seal layer), described in WO 2009/000403 A1 or in WO 2010/139409 A1. A cover foil with excellent transparency, capability of being pushed through and capability of being metallized is based, e.g., on a carrier substrate which is 30 μm thick and has a layer structure COC/PP/COC, wherein as a COC material there is used, given its high stiffness, in particular the commercial type TOPAS® 6013F-04.

The invention claimed is:

1. A packaging in the form of a blister for pharmaceutical products, the packaging comprising:

a plastic foil molded part and a cover foil in the form of a push-through foil;

wherein the plastic foil molded part defines a front side of the packaging and the cover foil defines a back side of the packaging;

wherein the cover foil comprises a transparent or semitransparent carrier substrate provided with a semitransparent layer, the semi-transparent layer comprising a multi-layer structure with two semi-transparent metallic layers and a dielectric layer arranged between the two semi-transparent metallic layers or a layer system comprising two semi-transparent metallic layers and an intermediate color layer;

wherein the semi-transparent layer is constituted such that the cover foil has a first, visually recognizable color upon viewing in incident light and has a second, visually recognizable color upon viewing in transmitted light.

2. The packaging according to claim 1, wherein the two semi-transparent metallic layers are formed from a metal and the metal is respectively chosen from the group consisting of Al, Ag, Ni, Cr, Cu, Au and an alloy of one or several of the hereinabove mentioned elements and the dielectric layer is an $SiO_2$ layer, a ZnO layer, an $Al_2O_3$ layer, a $TiO_2$ layer, a layer made of a nitride or oxynitride of one of the elements Si, Zn, Al or Ti, or an $MgF_2$ layer, or a nitrocellulose layer obtainable, e.g., by printing technology.

3. The packaging according to claim 2, wherein the two semi-transparent metallic layers are chosen independently of each other from Al or Ag and the dielectric layer is an $SiO_2$ layer.

4. The packaging according to claim 1, wherein the cover foil appears golden upon viewing in incident light and has a blue color tone upon viewing in transmitted light.

5. The packaging according to claim 1, wherein the plastic foil molded part is transparent.

6. The packaging according to claim 1, wherein the packaging is a tablet packaging.

* * * * *